US007051910B2

(12) United States Patent
Sprague et al.

(10) Patent No.: US 7,051,910 B2
(45) Date of Patent: May 30, 2006

(54) FIELD DESK APPARATUS

(76) Inventors: Ronald L. Sprague, 552 East Ivy St., Mesa, AZ (US) 85203-2511; Althea Antonette Sprague, 552 East Ivy St., Mesa, AZ (US) 85203-2511

( * ) Notice: Subject to any disclaimer, the term of this patent is extended or adjusted under 35 U.S.C. 154(b) by 334 days.

(21) Appl. No.: 10/199,828

(22) Filed: Jul. 19, 2002

(65) Prior Publication Data

US 2004/0011841 A1 Jan. 22, 2004

(51) Int. Cl.
*A45F 3/04* (2006.01)

(52) U.S. Cl. ..... 224/638; 224/270; 224/262; 224/628

(58) Field of Classification Search ..... 224/270, 224/260, 261, 262, 628, 629, 637, 638, 586, 224/576, 197; 190/11, 1
See application file for complete search history.

(56) References Cited

U.S. PATENT DOCUMENTS 1,542,163 A * 6/1925 Morde ..... 224/646
3,541,976 A * 11/1970 Rozas ..... 108/43
D248,596 S * 7/1978 Neyman ..... D29/101.1
4,466,659 A * 8/1984 Carpentier et al. .... 297/188.06
4,846,382 A * 7/1989 Foultner et al. ..... 224/483
5,269,229 A * 12/1993 Akapatangkul ..... 108/44
5,397,040 A * 3/1995 Lee ..... 224/679
5,503,620 A 4/1996 Danzger
5,560,524 A * 10/1996 Brune ..... 224/155
5,642,674 A * 7/1997 Joye et al. ..... 108/43
5,667,114 A 9/1997 Bourque
5,776,087 A 7/1998 Nelson et al.
5,915,606 A * 6/1999 Jensen ..... 224/148.6
6,006,970 A * 12/1999 Piatt ..... 224/257
6,182,931 B1 * 2/2001 Richard ..... 248/102
6,216,931 B1 * 4/2001 Trawinski ..... 224/583
6,349,864 B1 * 2/2002 Lee ..... 224/270
6,381,127 B1 * 4/2002 Maddali et al. ..... 361/683
6,790,201 B1 * 9/2004 Meyer ..... 604/345
2002/0074370 A1 * 6/2002 Quintana et al. ..... 224/262

* cited by examiner

*Primary Examiner*—Tri M. Mai
(74) *Attorney, Agent, or Firm*—Edward J. Mischen

(57) ABSTRACT

A field desk apparatus, designed to be worn by a user, is configured with two soft triangular structures having a work platform as a common element. Shoulder straps and support straps form the remaining two elements for each of the soft triangular structures, respectively. The weight of a work piece, supported by the work platform, is distributed to a lateral belt of the field desk apparatus, via the soft triangular structures, to ergonomically balance the weight of the work piece about the user.

18 Claims, 6 Drawing Sheets

38

FIELD DESK APPARATUS

BACKGROUND OF THE INVENTION

The present invention relates to portable workplace equipment and more specifically to a portable field desk apparatus.

The sophistication of laptop computers has brought about a need for more sophisticated uses of such computers. Although the laptop computer has become more portable, limitations on portability have been brought forth by the environments in which the laptops are used.

For example, laptop computers are used in the area of field engineering and facility redesign where large lists of asset data are recorded. The asset data includes the description, characterization, and serial number for properties such as equipment, fixtures, and electrical components. Physical access to the property data is often limited by space or location constraints. Likewise, the associated serial numbers are regularly placed in inconspicuous locations. The recording of the required data on a laptop computer often requires a combination of a balancing of the user's body, accompanied with a juggling of the laptop computer. In many instances, the laptop computer must be placed in a more convenient location while the data is recorded using pencil and paper or is temporarily recorded in the memory of the user. Thus, an intermediate, error prone, and inefficient step is inserted into the process.

Another example of a popular use of the portable computer relates to inventory tracking in retail business establishments. Retail businesses such as grocery, drug, automotive parts, shoe, and clothing stores periodically record physical inventory data. The environment includes inventory items that must be identified, characterized, and counted. The items are generally located above or below a convenient ergonomic operating level for the user recording the inventory data. Therefore, the user must reach, climb, bend, or stoop to perform the recording task. Incorporating a laptop computer into such a task again requires a juggling process between the user and the laptop computer.

Attempts to solve the aforementioned problems include the design of portability devices such as portable computer stands, strap-on computers, and computer sling desks.

Portable computer stands provide a lightweight support structure on which to place a laptop computer or test equipment. Although the computer stand offers portability, it is limited by the environment in which it is placed and is not capable of moving easily with the user.

The strap-on computer is truly portable and moves with the user. However, the strap-on configuration is generally mounted around the upper leg area of the user and is not easily accessed. The user must bend over from the waist to enter data and to see the computer display. Thus, the strap-on device yields to inconvenience in exchange for portability. Additionally, the continuous bending of the user to enter data places an undesired ergonomic strain on the user's back.

Computer slings consist of a strap that attaches to a work platform at two points. The platform is fabricated from a rigid plastic or metal-like material. The platform supports the laptop computer, and the strap wraps around the back of the neck or the shoulders of the user to support the platform. The user's stomach area provides a resting point for the front edge of the work platform. The apparatus is designed to be portable with the computer but is not portable in use to due instability caused by the support techniques. From an ergonomic perspective, the majority of the weight of the supported laptop computer is translated to the neck or shoulders of the user, causing undue stress. Furthermore, the floating support offered to the work platform, by the user's stomach, causes the user's back muscles to contract subconsciously to compensate for the instability of the apparatus assembly, thus creating stress in the back muscles. Furthermore, the rigid nature of the work platform has potential as a safety risk, to the user, in an environment where mobility is required in a restricted area.

Hence, there is a need for a truly general use portable field desk apparatus that is lightweight, provides a stable work platform, moves comfortably with the person using the apparatus, provides a degree of safety in mobility, and is ergonomically designed to alleviate unnecessary stresses on the user's neck, shoulders, and back.

SUMMARY OF THE INVENTION

Accordingly, it is the object of the present invention to provide an improved portable field desk apparatus.

It is another object of the present invention to provide an improved portable field desk apparatus that is ergonomically balanced.

It is yet another object of the present invention to provide an improved portable field desk apparatus that is easily re-configured to be transportable when used in a limited space environment.

It is a further object of the present invention to provide an improved portable field desk apparatus that incorporates a safe work platform structure.

It is a still a further object of the present invention to provide an improved portable field desk apparatus that is optimized for transportability when not in use.

More generally, the present invention is a field desk apparatus that is intended to be operable with a work piece such as a laptop computer, a test equipment, a manual, or a pad of paper. A system of a soft triangular arrangement of shoulder straps, support straps, and work platform assembly, in combination with a lateral belt, distributes the weight of the work piece in such a manner as to minimize ergonomic stresses on the user. Additionally, the integration of lightweight materials and interconnect features provide a strong, safety-enhanced, collapsible structure that is easily and conveniently transportable.

DETAILED DESCRIPTION OF THE DRAWINGS

The present invention is a field desk apparatus suitable for use in a number of applications including limited space environments and hostile mediums. A work piece is supported by the work piece platform of the field desk apparatus. The work piece is enclosed within a triangulated system constructed of the work piece platform assembly, shoulder straps, and support straps. The weight of the work piece is distributed through the triangulated system, to points along the front of the shoulder straps, and to a front portion of a lateral belt that encircles the user's waist. The shoulder straps further distribute the weight of the work piece to rearward points of the waist belt. The field desk apparatus is adjustable for adapting the weight distribution of the work piece to the requirements of the user, thus providing an ergonomically balanced support system and alleviating undue stress felt on the user's neck and shoulders.

Figure 1:
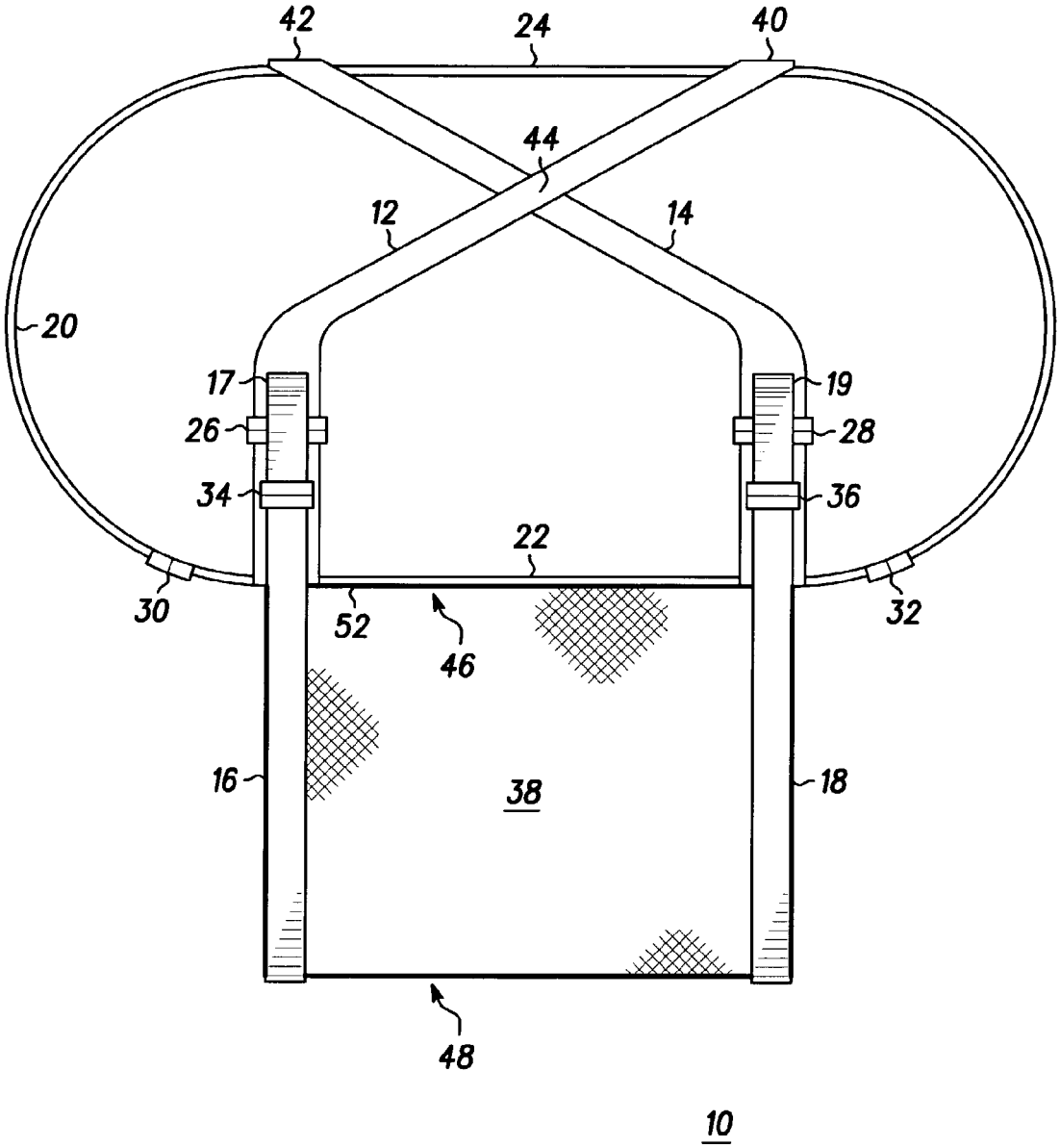
FIG. 1 illustrates a top view of the field desk apparatus of the present invention.

Looking at FIG. 1, a top view of field desk apparatus 10 is shown. Shoulder strap 12 is attached to lateral belt 20, rear portion 24 at rear attachment point 40. Shoulder strap 12 is coupled through shoulder strap coupler 26 and attached to front portion 22 of lateral belt 20. Support strap 16 is coupled to forward attachment point 17 of shoulder strap 12 through support strap coupler 34 and is attached to the underside of work platform assembly 38. Work platform assembly 38 serves as the work platform for a work piece.

Shoulder strap 14 is attached to lateral belt 20, rear portion 24 at rear attachment point 42 and attached, in a crossing fashion, to shoulder strap 12 at attachment point 44. Shoulder strap 14 is coupled through shoulder strap coupler 28 to front portion 22 of lateral belt 20. Support strap 18 is coupled to forward attachment point 19 of shoulder strap 14 through support strap coupler 36 and attached to the underside of work platform assembly 38.

Work platform assembly 38 is attached to front portion 22 of lateral belt 20 via platform hinge 52 of the work platform assembly. The method of attachment is, but is not limited to, sewing.

Front portion 22 and rear portion 24, of lateral belt 20, are connected together through lateral belt coupler 30 and lateral belt coupler 32. The two piece arrangement for the lateral belt facilitates ease of assembly for the field desk apparatus.

Shoulder straps 12 and 14, and support straps 16 and 18 are fabricated from 1.0 inch wide lightweight rip-stop nylon webbing material. The width is selected to provide comfortable support and to accommodate the interface with shoulder strap couplers 26 and 28 and support strap couplers 34 and 36, respectively.

Front portion 22 of lateral belt 20 is fabricated from 3.0 inch light weight nylon webbing and tapered to a 2.0 inch width at the respective ends to accommodate assembly with lateral belt couplers 30 and 32. Rear portion 24, of lateral belt 20 is fabricated from cotton canvas material layered with a belt stiffener fabric to provide rigidity.

Alternatively, the shoulder straps, support straps, and lateral belt of the field desk apparatus are fabricated of canvas, cotton, webbing, or other lightweight materials known in the art or a combination thereof.

Lateral belt couplers 30 and 32, for example, are 2.0 inches wide and manufactured by ITW Nexus, model number SR 101–1200. Shoulder strap couplers 26 and 28, and support strap couplers 34 and 36, for example, are 1.0 inch wide and manufactured by ITW Nexus, model number SR 101–1100. Optionally, rings, hook and loop fasteners, snaps, and buckles are used for couplers.

Work platform assembly 38 is constructed of cotton canvas material to form a pouch sealed at front end 46 of the work platform assembly. Other materials selected for pouch construction include, but are not limited to, canvas, cotton, webbing, or other lightweight materials.

Platform hinge 52 is a strip of cotton canvas material, sewn to front portion 22 of lateral belt 20 and to the work platform assembly. Alternatively, platform hinge 52, is an integral fabric with the work platform assembly pouch, overlapping at front edge 46. A semi-flexible polycarbonate sheet, inserted into the work platform assembly pouch as illustrated in FIG. 2A, provides firmness for work platform assembly 38.

Figure 2A:
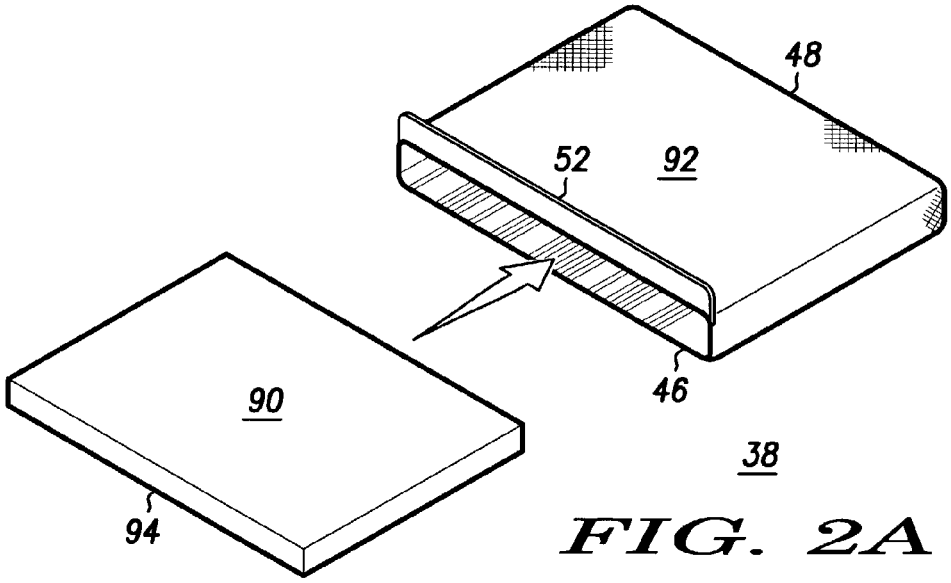
FIG. 2A illustrates an exploded view of the work piece platform assembly of the present invention.

Referring now to FIG. 2A, details of work platform assembly 38 of the field desk apparatus are shown. The assembly is in the form of a pouch. A semi-flexible sheet is inserted into the front opening of the pouch and the pouch is sewn shut. The assembly is attached to a fabric hinge for purposes of coupling the pouch to a lateral belt of the field desk apparatus.

Platform pouch 92 is constructed of cotton canvas material, sewn together. Alternatively, platform pouch 92 is cotton, canvas, and other lightweight fabrics. The platform pouch has back edge 48 that is sewn shut. Front edges 46, of the platform pouch, define a portal through which semi-flexible insert 90 is inserted into the pouch. For clarity of illustration, the height of the portal is exaggerated in FIG. 2A. Front edges 46 are sewn shut and sewn further to fabric platform hinge 52 for attachment to the lateral belt of the field desk apparatus.

Semi-flexible insert 90 is one-sixteenth inch thick polycarbonate plastic. The insert is selected from suitable materials and thicknesses to provide a semi-flexible structure designed to bend and flex under stress, without fracturing. Thus, injury to the user of the field desk apparatus is minimized should the user fall against the work platform assembly. Semi-flexible insert 90 is rectangular in shape. Alternatively, front edge 94 of the semi-flexible insert is curved to facilitate fitting the curvature of the waist of the user of the field desk apparatus.

Figure 2B:
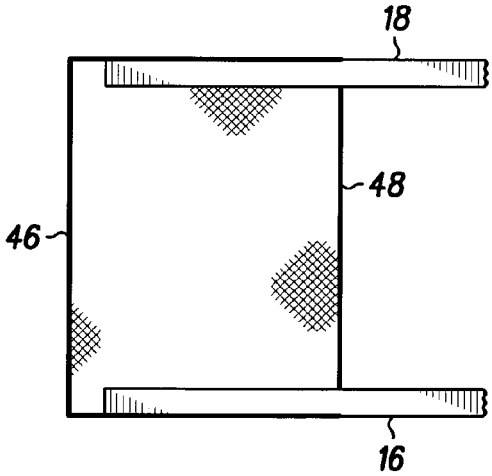
FIG. 2B illustrates a plan view of the underside of the work piece platform assembly of the present invention.

FIG. 2B shows a bottom view of the work platform assembly and the configuration for the attachment of the support straps.

Support straps 16 and 18 form around back edge 48 of work platform assembly 38, the work platform assembly having front edge 46. The support straps are attached by sewing along the common length, i.e., attachment points, to platform pouch 92 at the underside of work platform assembly 38 and support straps 16 and 18, respectively. Alternatively, the support straps are attached by hook and loop fasteners, gluing, bonding, and snaps.

Figure 2C:
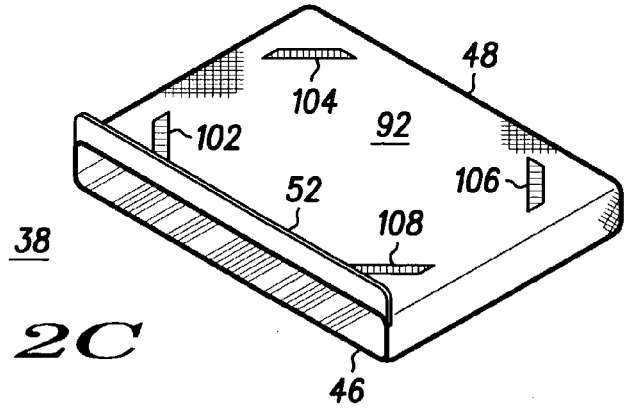
FIG. 2C illustrates a method for securing a work piece to the work piece platform assembly of the present invention.

Referring to FIG. 2C, details for securing a work piece to work platform assembly 38, of the field desk apparatus, are shown. The securing mechanism, i.e., work piece straps 102, 104, 106, and 108 are affixed to the top platform pouch 92 of the work platform assembly to hold the work piece securely in place. The straps are elastic material, one-quarter inch wide, and attached to work platform assembly 38 by sewing. The straps embrace the work piece at each of its corners, in a diagonal fashion. Alternatively, straps 102, 104, 106, and 108 are fabric and rip-stop nylon, in widths suited to accommodate the mounting of the work piece. Alternative fastening means for the work piece straps include, but are not limited to, hook and loop fasteners, snaps, bonding, and gluing.

Figure 3:
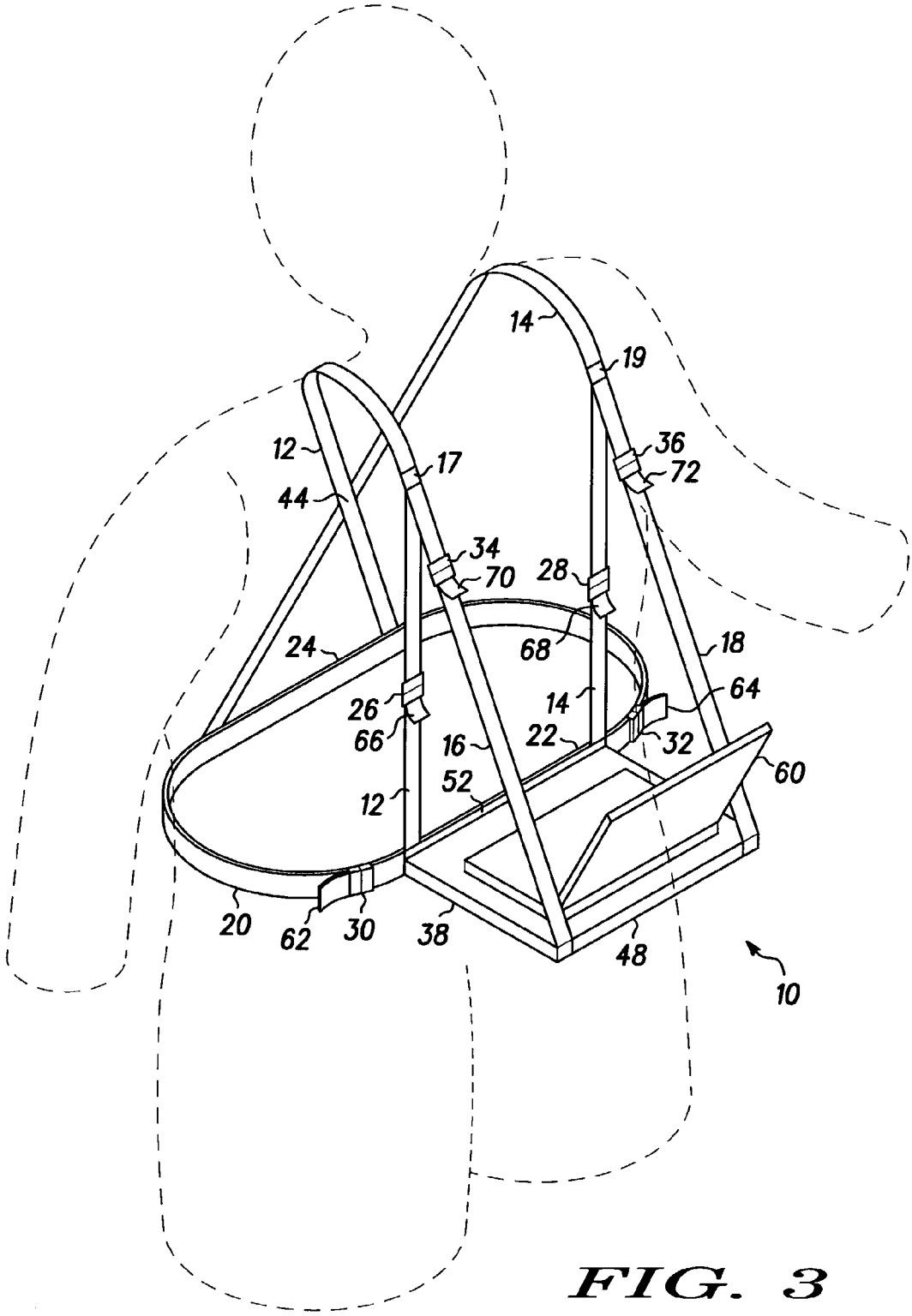
FIG. 3 illustrates a view of the field desk apparatus as used in an application.

Referring to FIG. 3, an application of the field desk apparatus of FIG. 1 is shown. The field desk apparatus is worn by a user and supports a laptop computer work piece within the supporting structure of the apparatus.

In FIG. 3, shoulder straps 12 and 14 are worn over the respective shoulders of the user and are attached at common attachment point 44 and further attached to rear portion 24 of lateral belt 20. Shoulder strap 12 is coupled through shoulder strap coupler 26 and attached to front portion 22 of lateral belt 20. Shoulder strap 14 is coupled through shoulder strap coupler 28 and attached to front portion 22 of lateral belt 20. Front portion 22 of lateral belt 20 is coupled through lateral belt couplers 30 and 32 to rear portion 24 of lateral belt 20. Shoulder strap couplers 26 and 28 provide length adjustment for shoulder straps 12 and 14. The adjustment of the shoulder straps permits lateral belt 20 to rest at approximately the hip level of the user.

Work platform assembly 38 provides a mounting surface for laptop computer 60. Front edge 46 of the assembly is attached to front portion 22 of lateral belt 20 through platform hinge 52. A lateral weight vector, of the weight of the laptop computer, is transferred to lateral belt 20 via platform hinge 52.

Support straps 16 and 18 are coupled to shoulder straps 12 and 14 at forward attachment points 17 and 19, respectively, through support strap couplers 34 and 36. Support strap couplers 34 and 36 respectively separate support straps 16 and 18, each, into two sections. Support straps 16 and 18 are attached at a second end to the underside of work platform assembly 38, passing around back edge 48 of the work platform assembly.

Thus, a soft triangular structure is formed of members support strap 16, the front portion of shoulder strap 12, and work platform assembly 38. A second soft triangular structure is formed of members support strap 18, the front portion of shoulder strap 14, and work platform assembly 38.

An angular weight vector, of the weight of laptop computer 60, is transferred along support straps 16 and 18 to attachment points 17 and 19, at shoulder straps 12 and 14 respectively. At the attachment points, components of the angular vector are translated through shoulder straps 12 and 14 to lateral belt 20 to provide an even distribution of the weight of laptop computer 60 along the shoulder straps and to the lateral belt.

It can thus be appreciated that the soft triangular configurations within the field desk apparatus provide a means for distributing the weight of the user work piece in an ergonomic manner.

Support strap couplers 34 and 36 additionally provide an adjustment mechanism for support straps 16 and 18 to lengthen or shorten the respective strap couplers. The adjustment further positions work platform assembly 38 and balances the weight of laptop computer 60, i.e., the work piece.

Figure 6:
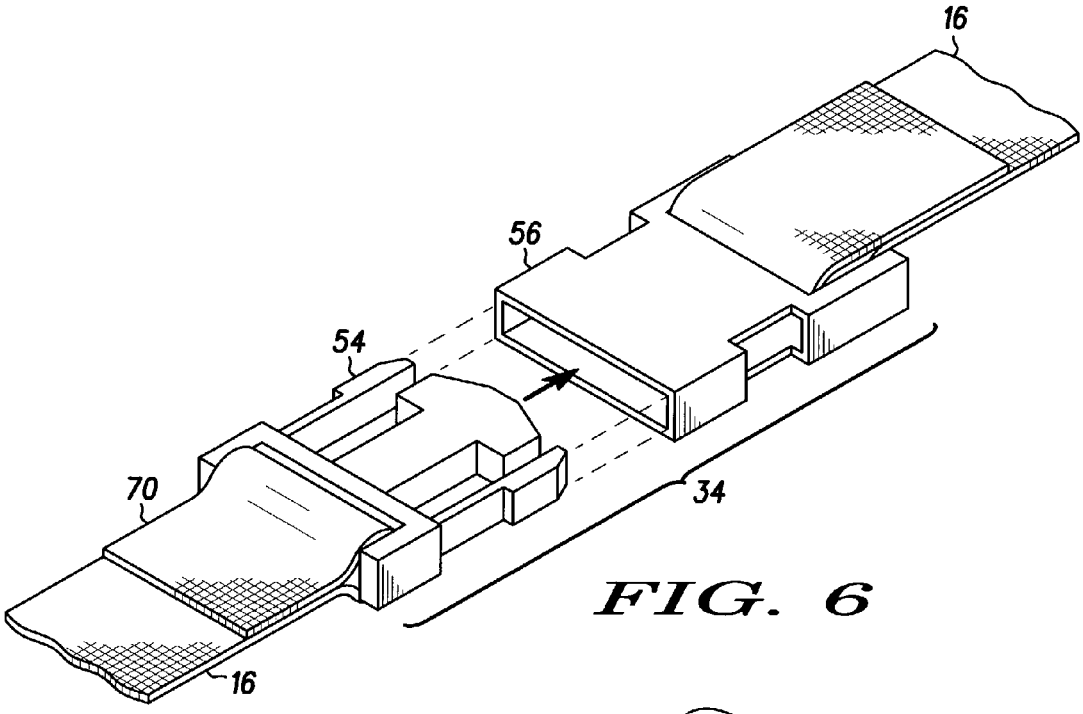
FIG. 6 illustrates an exploded view of the shoulder strap coupler used in the field desk apparatus.

Referring briefly to FIG. 6, an exploded view of support strap coupler 34 is shown. One portion of support strap 16 (reference FIG. 3) is routed through female end 56 of the support strap coupler and is fixed upon itself, for example, by sewing. The second portion of support strap 16 (reference FIG. 3) is attached to work platform assembly 38 at one end, is looped through female end 56 of support strap coupler 34 at a second end. Overlap 70 overhangs the male end of the coupler to provide a grasping mechanism for adjusting the length of support strap 16.

In FIG. 3, support strap coupler 28 and support strap 18 are configured in a similar manner to support strap coupler 34 and support strap 18 of FIG. 6, as are shoulder straps 12 and 14, and their respective shoulder strap couplers 26 and 28. Likewise, lateral belt 20 and lateral belt couplers 30 and 32 are assembled in a similar manner. Overlaps 62 and 64 of lateral belt couplers 30 and 32, respectively, provide a convenient means of adjusting the size of lateral belt 20 to accommodate a comfortable fit of the lateral belt at or about the hip level of the user.

Polarization of lateral belt couplers 30 and 32 is incorporated into the construction of lateral belt 20 to provide for ease of assembly of the field desk apparatus by the user. For example, the male portion of lateral belt coupler 30 is attached to right-hand portion of lateral belt 20 while the female portion of lateral belt coupler 32 is attached to the left-hand portion of lateral belt 20. The female portion of lateral belt coupler 30 is attached to the right-hand side of front portion 22 of lateral belt 20. The male portion of lateral belt coupler 32 is attached to the left-hand side of front portion 22. In use, the male end of the coupler is inserted into the female end of the coupler. Thus, lateral belt 20 is oriented in a one-way polarized configuration to facilitate ease of assembly.

By now, it can also be appreciated that the polarization of the couplers within the lateral belt assembly simplifies the ease of assembly of the field desk apparatus for the user.

Looking again to FIG. 3, overlaps 70 and 72 are used to adjust the length of support straps 16 and 18, respectively. The adjustment of support straps 16 and 18 permit work platform assembly 38 to be set at an angle. The angle of the work platform assembly facilitates access to the keyboard of laptop computer 60, in an ergonomic manner for the user of the apparatus. Additionally, the adjustment of the support straps permits the weight of the work piece to be distributed in a way, i.e., ergonomically balanced, to provide comfort to the user.

Pulling overlaps 70 and 72, of support straps 16 and 18 respectively, to their maximum lengths raises work platform assembly 38 to a near vertical position. Correspondingly, laptop computer 60 is thus firmly sandwiched between the user and the work platform assembly, while hinge 52 operates cooperatively to prevent the computer from falling vertically from the field desk apparatus. The near vertical positioning of laptop computer 60 distributes the weight of the laptop computer vertically along shoulder straps 12 and 14, and horizontally along lateral belt 20.

It can thus be even further appreciated that the inventive field desk apparatus provides a convenient means for transporting a work piece while minimizing the detrimental effects of the weight of the work piece on the user.

Overlaps 66 and 68 are used to adjust the length of shoulder straps 12 and 14, respectively. The adjustment of the shoulder straps facilitates the location of lateral belt 20 at or above the hips of the user. The location of the lateral belt provides a comfortable support for the weight of the work piece by distributing the weight of the work piece laterally along the hipline of the user.

Figure 4:
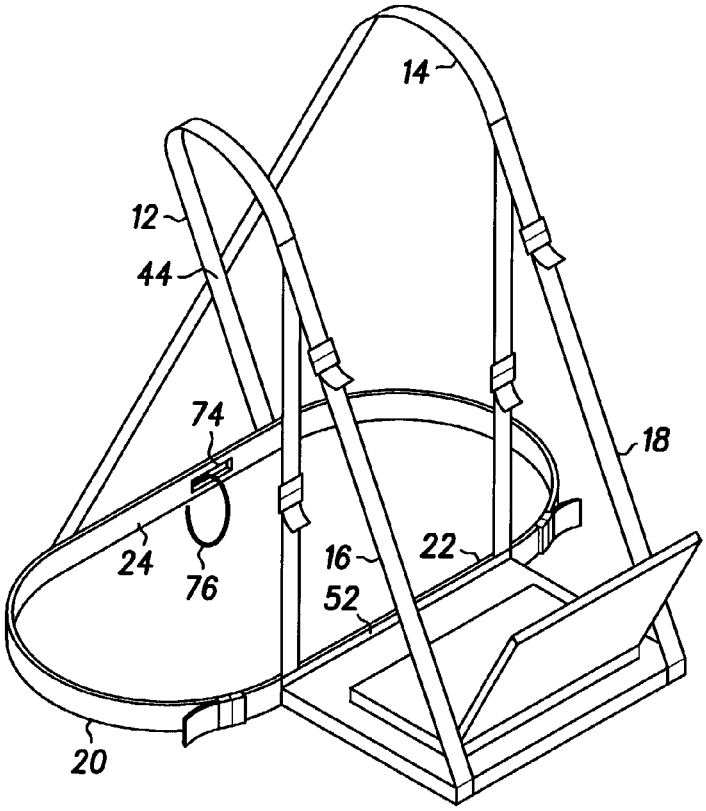
FIG. 4 illustrates an alternate embodiment of the field desk apparatus as used in an application.

Referring to FIG. 4, an alternate embodiment of field desk apparatus 10, as worn by a user in an application, is shown. Shoulder strap 12 crosses the back of the user and attaches to rear portion 24 of lateral belt 20. Shoulder strap 14 crosses the back of the user and attaches to rear portion 24 of lateral belt 20. Shoulder straps 14 and 12 are attached at common attachment point 44. Common attachment point 44 further balances the weight of the work piece supported by field desk apparatus 10 in a triangular fashion as shown in the view of FIG. 4. The method of attachment is, but is not limited to, sewing.

Looking further at FIG. 4, an aperture is formed in rear portion 24 of lateral belt 20. Belt strap 76, fabricated of nylon webbing, passes through aperture 74 for purposes of encircling an external belt (not shown) worn by the user of the field desk apparatus. Other materials for the belt strap include canvas, cotton, and webbing. The ends of belt strap 76 are fastened together using a hook and loop fastener for securing the belt strap, and hence lateral belt 20, to the user belt. The ends of belt strap 76 are fastened alternatively by, but not limited to, snaps and buckles.

In use, the weight of the work piece housed by filed desk apparatus 10, experts a downward force that is translated through the field desk apparatus support straps to lateral belt 20 via shoulder straps 12 and 14 (See FIG. 3). Belt strap 76 distributes a portion of the downward force exerted on the lateral belt to the external belt of the user.

It can now be appreciated that the belt strap configuration of the present invention provides a beneficial mechanism for distributing the weight of the work piece housed by the inventive field desk apparatus.

Figure 5:
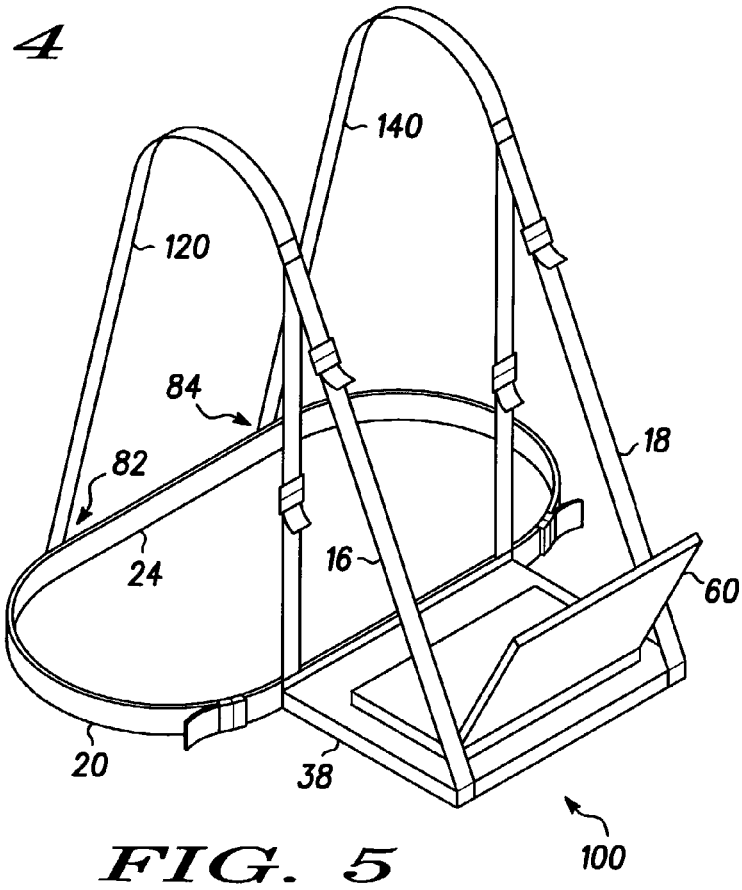
FIG. 5 illustrates an embodiment of the present invention exhibiting an alternate shoulder support arrangement.

Referring to FIG. 5, the field desk apparatus of FIG. 1 is illustrated, as worn by a user, and shown with an alternate arrangement of the shoulder straps.

In FIG. 5, shoulder straps 140 and 120, of field desk apparatus 100, are configured in a parallel arrangement and are attached to rear portion 24 of lateral belt 20 at attachment points 84 and 82, respectively. The method of attachment is, but is not limited to, sewing. Support straps 16 and 18 are attached to the front of shoulder straps 120 and 140 respectively, as described in the arrangement for FIG. 1. Work platform assembly 38 is coupled to the front portion of lateral belt 20 via platform hinge 52. Laptop computer 60 is rests on work platform assembly 38 and is housed within the structure defined by the triangular members, i.e., work platform assembly 38, the front of shoulder straps 120 and 140, and support straps 16 and 18, respectively.

Figure 7:
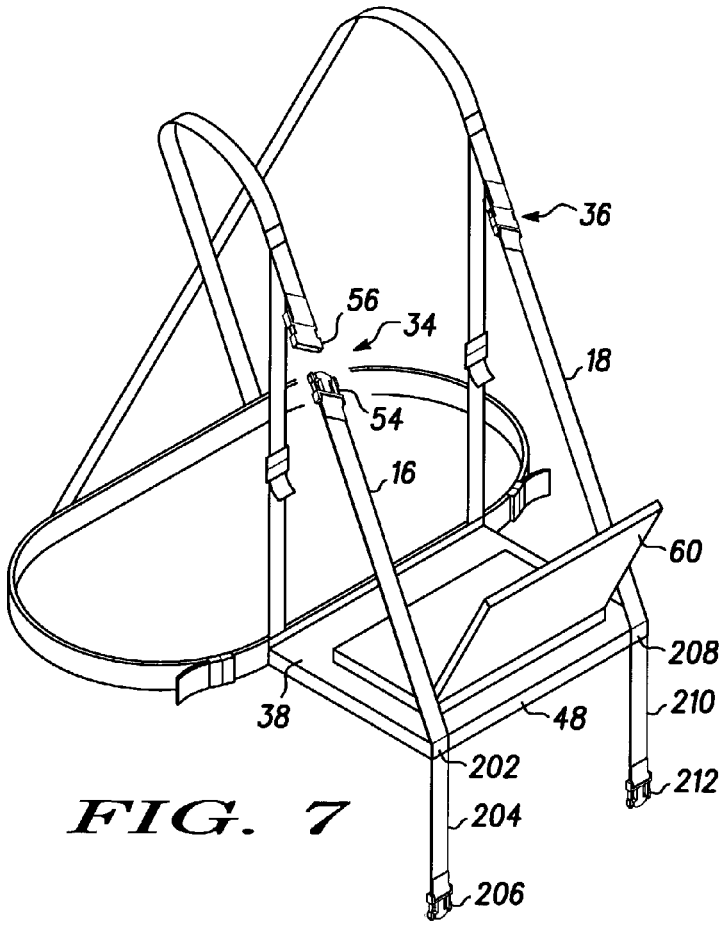
FIG. 7 illustrates an alternate embodiment for providing portability for a work piece used in application with the field desk apparatus of the present invention.

Referring to FIG. 7, an alternate embodiment for providing portability for a work piece used in application with the field desk apparatus of the present invention is shown. Stowage straps 204 and 210 are attached at respective ends to back edge work platform assembly 38 of field desk apparatus 10 of FIG. 3. The method of attachment is, but is not limited to, sewing. Male stowage coupler ends 206 and 212 are coupled, respectively, to stowage straps 204 and 210.

Stowage straps 204 and 210 are fabricated of nylon webbing of a width, for example, of one inch, compatible with the structure of FIG. 3. Other materials for the stowage straps include canvas, cotton, and webbing. Male stowage coupler ends are 1.0 inch wide and manufactured by ITW Nexus, model number SR 101–1100.

To secure a work piece for transit, for example, the user of the field desk apparatus first unfastens support strap coupler 34. Male stowage coupler end 206 is raised toward, and fastened to female end 56 of support strap coupler 34. Thus, one side of the work piece is secured for transit. Next, the user unfastens support strap coupler 36 and fastens male stowage coupler end 212 to the female end of support strap coupler 36, thus securing the second side of the work piece for transit. Support straps 204 and 210 are adjustable in length to provide snug adherence of the work piece to the user. Alternatively, the support straps are of fixed length and customized for user preference.

It can now be appreciated that the innovative stowage strap and coupler system of the present invention cooperates to provide an easy and efficient method of securing a work piece for transit in a limited work space environment.

Figure 8A:
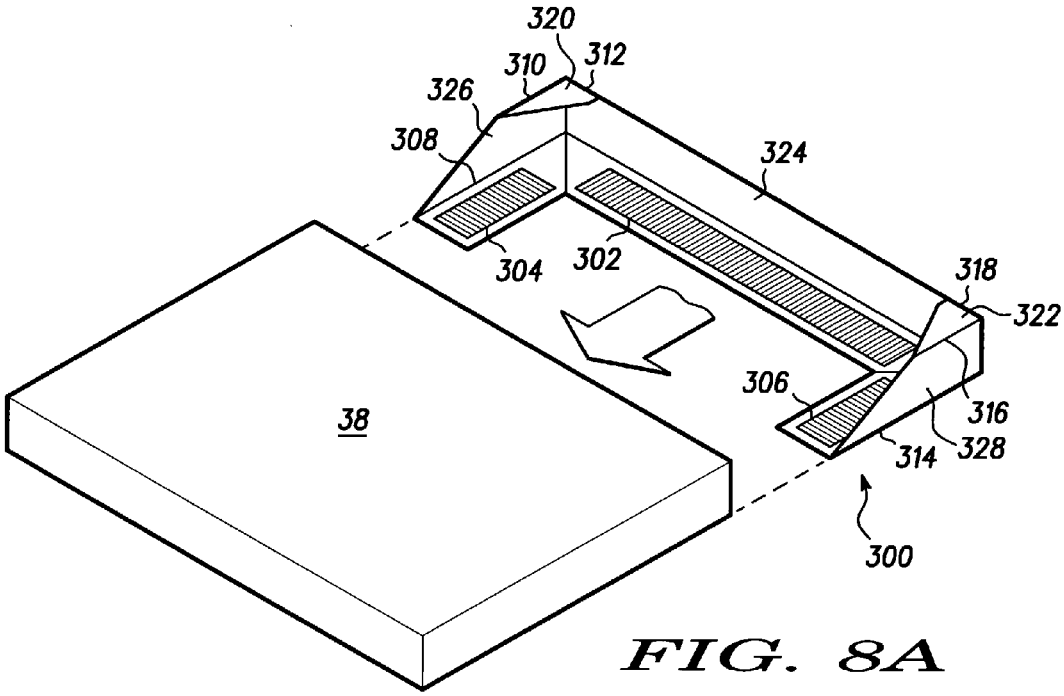
FIG. 8A illustrates an alternate means for securing a work piece to the field desk apparatus of the present invention.

Referring to FIG. 8A, an alternative arrangement is shown for securing a work piece to the field desk apparatus of the present invention. Rear securing box 300 is fabricated from a single-piece flexible material, e.g., rip-stop nylon. Securing box 300 fastens to the underside of work platform assembly 38 using fasteners 302, 304, and 306. Fasteners 302, 304, and 306 are, but are not limited to, loop and stick fasteners.

The work piece (not shown) is secured to work platform assembly at the top by top surfaces 320 and 322 and at the back by back surface 324 of securing box 300. The work piece is further secured at the sides by side surfaces 326 and 328 of securing box 300.

Figure 8B:
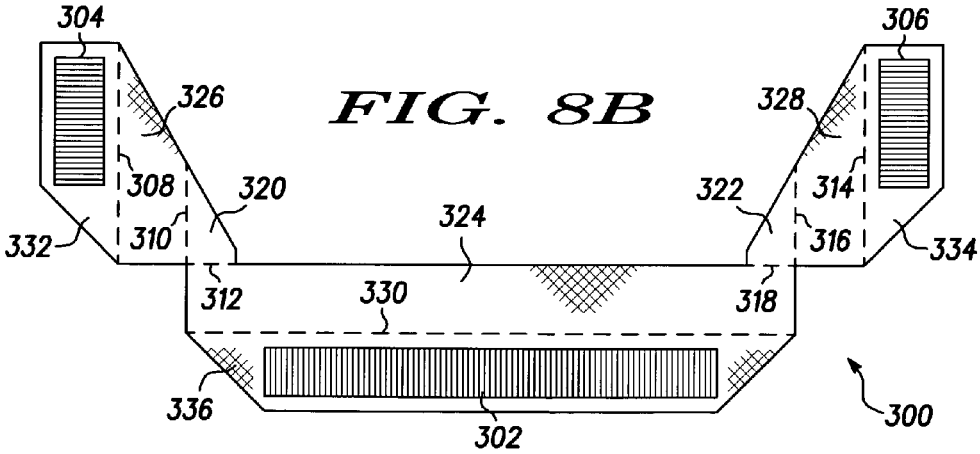
FIG. 8B illustrates a bottom view of the alternate means for securing a work piece of FIG. 8A of the present invention.

Referring now to FIG. 8B, details of the bottom view of securing box 300 are shown. Fasteners 304, and 306 are affixed to the side-bottom surfaces 332 and 334, respectively, of securing box 300. Fastener 302 is affixed to the back-bottom surface 336 of securing box 300. The fasteners are affixed by sewing and alternatively by gluing.

Securing box 300 is formed as follows. For reference, back surface 324 remains stationary in reference to the plane of FIG. 8B. Back-bottom surface 336 is folded upward, along folding line 330, at a ninety degree angle to back surface 324.

Top surface 320, side surface 326 and side-bottom surface 332, are folded downward, along folding line 312, at a ninety degree angle to back surface 324. Side surface 326 and side-bottom surface 332 are next folded downward, along folding line 310. Side-bottom surface 332 is next folded at folding line 308 to complete formation of one side of the box-like structure shown in FIG. 8A.

Similarly, top surface 322, side surface 328, and side-bottom surface 334 are folded downward, along folding line 318, at a ninety degree angle to back surface 324. Side surface 328 and side-bottom surface 334 are next folded downward, along folding line 316. Side-bottom surface 334 is next folded at folding line 314 to complete formation of the second side of the box-like structure shown in FIG. 8A.

The structure of securing box 300 is repeated to form a similar securing box for securing the front of the work piece (not shown).

It is thus appreciated that an improved work piece securing mechanism can be easily manufactured from a single-piece, planar flexible fabric.

It can now be appreciated that the components of the present invention are connected to provide a truly portable field desk apparatus.

It can be further appreciated that the lightweight features of the components of the present invention contribute a very small component of weight when compared to the weight of the work piece affixed to the invention.

It can be further appreciated that the soft triangular support structure of the present invention, in combination with the shoulder straps and lateral belt, provides for the distribution of weight of the attached work piece such that the distribution of weight is ergonomically balanced for the user.

It can be even further appreciated that the adjustability and the hinging configuration of the soft triangular support structure, of the present invention, permits a rapid reconfiguration of the field desk apparatus from an operating mode to a transportation mode, while securely holding the work piece in place.

It can be even more so appreciated that the adjustability of the present invention facilitates ergonomic placement of the work platform assembly, and hence the work piece, to alleviate undue stress on the extremities of the user.

It can be still further appreciated that within the inventive field desk apparatus, the utilization of a semi-flexible insert within the work platform assembly contributes to a safe environment for the user, while providing a strong and lightweight support for the work piece.

While specific embodiments of the present invention have been shown and described, further modifications and improvements will occur to those skilled in the art. It is understood that the invention is not limited to the particular forms shown, and it is intended for the appended claim to cover all modifications that do not depart from the spirit and the scope of this invention.

We claim:

1. A field desk apparatus comprising:

a work platform assembly designed for supporting a work piece, said work platform assembly having a first edge coupled through an attachment means to a front portion of a lateral belt, wherein said lateral belt is designed for encircling the waist of an individual;

a first shoulder strap coupled to said front portion of said lateral belt at a first attachment point and further coupled to a rear portion of said lateral belt at a second attachment point;

a first support strap coupled to a first contact point of said work platform assembly and further coupled to said first shoulder strap at a forward attachment point;

a second shoulder strap coupled to said front portion of said lateral belt at a third attachment point and further coupled to a rear portion of said lateral belt at a fourth attachment point;

a second support strap coupled to a second contact point of said work platform assembly and coupled to said second support strap at a forward attachment point;

a securing box for securing said work piece to said work platform assembly, said securing box fabricated from a planar, single-piece flexible material, said securing box having first, second, third, fourth, fifth, six, and seventh fold lines for forming a box-like structure with first and second sides, a back, and a plurality of bottom surfaces; and a plurality of fasteners affixed respectively to said plurality of bottom surfaces, respectively, for fastening said securing box to said work platform assembly.

2. The field desk apparatus of claim 1, wherein said work platform assembly comprises:

a pouch having a portal at a first end for receiving a semi-flexible sheet, wherein said semi-flexible sheet provides firmness to said work platform assembly.

3. The field desk apparatus of claim 2, wherein said semi-flexible sheet is of polycarbonate composition.

4. The field desk apparatus of claim 2, wherein said pouch is fabricated from cotton canvas material.

5. The field desk apparatus of claim 1, wherein said work platform assembly further comprises first, second, third, and fourth work piece straps mounted in a diagonal fashion atop of said work platform assembly and configured for receiving and securing a work piece.

6. The field desk apparatus of claim 1, wherein said attachment means is a fabric hinge.

7. The field desk apparatus of claim 1, wherein said first and second support straps are adjustable to provide ergonomic balance within the field desk apparatus.

8. The field desk apparatus of claim 1, wherein said lateral belt further comprises a first and second end coupled through a lateral belt coupler.

9. The field desk apparatus of claim 1, wherein said lateral belt further comprises a front portion and a rear portion.

10. The field desk apparatus of claim 9, wherein said front portion and said rear portion of said lateral belt are connected together through said first lateral belt coupler and a second lateral belt coupler.

11. The field desk apparatus of claim 9 wherein said lateral belt couplers are polarized to facilitate the ease of assembly of the field desk apparatus.

12. The field desk apparatus of claim 9, wherein said rear portion of said lateral belt further comprises an aperture for receiving a belt strap, said belt strap configured in a loop for securing said lateral belt to a belt worn by a user of the field desk apparatus.

13. A field desk apparatus comprising:

first and second soft triangular structures having a common work platform assembly and configured for supporting a work piece on said work platform assembly;

a lateral belt coupled to a said first and second soft triangular structures for purposes of ergonomic weight distribution of said work piece around said lateral belt;

a securing box for securing said work piece to said work platform assembly, said securing box fabricated from a planar, single-piece flexible material, said securing box having first, second, third, fourth, fifth, six, and seventh fold lines for forming a box-like structure with first and second sides, a back, and a plurality of bottom surfaces; and a plurality of fasteners affixed respectively to said plurality of bottom surfaces, respectively, for fastening said securing box to said work platform assembly.

14. The field desk apparatus of claim 13, wherein said first soft triangular structure further comprises:

a first support strap attached to said work platform assembly at a first attachment point and further attached to a first shoulder strap;

a second support strap attached to said work platform assembly at a- second attachment point and further attached to a second shoulder strap;

said lateral belt having a front portion and a rear portion;

said first and second shoulder straps having first and second ends, said first ends attached to said front portion of said lateral belt and said second ends attached to said rear portion of said lateral belt, respectively; and said front portion of said lateral belt coupled to a front edge of said work platform assembly.

15. The field desk apparatus of claim 14 wherein said first and second support straps are fabricated from nylon webbing material.

16. The field desk apparatus of claim 14, wherein said front portion of said lateral belt is coupled to said front edge of said work platform assembly through a fabric hinge.

17. The field desk apparatus of claim 14, wherein said first and second support straps are adjustable in length.

18. The field desk apparatus of claim 14, wherein said first and second shoulder straps are adjustable in length.

* * * * *